United States Patent [19]

Curington

[11] 3,944,003

[45] Mar. 16, 1976

[54] BORE HOLE AIR HAMMER

[75] Inventor: Alfred R. Curington, Houston, Tex.

[73] Assignee: Bakerdrill, Inc., Spartanburg, S.C.

[22] Filed: Apr. 24, 1972

[21] Appl. No.: 246,837

[52] U.S. Cl. ..... 173/73; 173/17; 173/66

[51] Int. Cl.[2] ..... E21B 5/00

[58] Field of Search ..... 173/66–72, 173/73, 78, 80, 132, 136, 137, 138, 64, 119, 17; 91/325

[56] References Cited

UNITED STATES PATENTS

| | | | |
|---|---|---|---|
| 1,601,733 | 9/1926 | Gilman | 173/105 |
| 2,580,203 | 12/1951 | Topanelian | 173/135 X |
| 2,887,989 | 5/1959 | Dulaney | 173/73 X |
| 2,917,025 | 12/1959 | Dulaney | 173/119 |
| 3,311,177 | 3/1967 | Collier et al. | 173/66 X |
| 3,409,091 | 10/1968 | Bardwell | 173/119 |
| 3,453,657 | 7/1969 | Bolton | 173/136 X |
| 3,503,459 | 3/1970 | Schindler | 173/136 X |
| 3,826,316 | 7/1974 | Bassinger | 173/73 |

*Primary Examiner*—Frank L. Abbott
*Assistant Examiner*—William F. Pate, III
*Attorney, Agent, or Firm*—B. Kriegel

[57] ABSTRACT

An air hammer embodying an outer housing structure connectable to a rotatable drill pipe string through which compressed air is conducted. A hammer piston reciprocates in the housing structure, compressed air being directed alternately to the upper and lower ends of the piston to effect its reciprocation in the structure, each downward stroke inflicting an impact blow upon the anvil portion of an anvil bit extending upwardly within the lower portion of the housing structure. The compressed air acts against the piston over the full internal cross-sectional area of the housing structure in delivering its impact blow, such compressed air acting downwardly over at least a portion of the piston area during its entire downward stroke, including its latter portion, during which the power or impacting air is being exhausted from the housing structure.

18 Claims, 11 Drawing Figures

BORE HOLE AIR HAMMER

The present invention relates to drill pipe apparatus for drilling a bore hole in a formation, and more particularly to pneumatically operated apparatus that imparts a percussive action to a drill bit while the latter is preferably being rotated, in order that the bit may cover substantially the full area of the bore hole bottom.

Prior air hammers, although operating effectively in drilling a bore hole, have been relatively complex, requiring a multiplicity of machining operations and provision of ports throughout the apparatus to direct the flow of compressed air, and its exhaust from opposite ends of the hammer piston reciprocating within the air hammer housing structure. The piston and housing structure embody the valve mechanism for alternately directing the flow of air to opposite ends of the hammer piston and exhausting it therefrom. Some prior air hammers do not utilize the full cross-sectional area of the hammer piston in delivering the power stroke or impact blow upon the companion anvil portion of the drill bit, thereby lowering the energy deliverable to the anvil bit when using the same unit inlet air pressure. Near the end of its power stroke, the hammer piston shifts to a position that permits the compressed air to exhaust from the apparatus, the hammer piston impacting against the anvil. During such exhaust phase, the lower portion of the hammer piston compresses air below the hammer piston, tending to reduce or cushion the force of the impact blow upon the anvil, which, of course, reduces the energy deliverable by the hammer piston against the anvil.

Applicant has heretofore developed a bore hole air hammer, which utilizes the full cross-sectional area of the piston subject to compressed air in impacting the piston against the anvil, the apparatus being disclosed in his U.S. application for "Bore Hole Air Hammer," Ser. No. 140,515, filed May 5, 1971. However, the air hammer disclosed therein represents a comparatively complex design, and is relatively costly to produce. In addition, it is subject to the compressing of the air between the lower end of the hammer piston and the anvil, as the piston approaches the end of its travel in impacting against the anvil.

Another air hammer is illustrated in U.S. Pat. No. 3,480,088. However, the full cross-sectional area of the hammer piston is not subject to the air pressure in delivering an impact blow against the anvil. In addition, the tool is relatively complex and costly to manufacture.

By virtue of the present invention, an air hammer is provided in which the housing structure in which the hammer piston is reciprocable is of a greatly simplified design and is much more economical to manufacture. The reciprocating hammer piston coacts with the housing structure in such manner as to alternately direct compressed air into the housing structure at the upper and lower ends of the piston, and alternately effects exhaust of the air from the upper and lower portions of the housing structure. The compressed air on the power stroke of the hammer piston acts over its full cross-sectional area, which is the full cross-sectional area of the inner wall of the housing structure itself, such area having a maximum value. After traversing the major portion of its power or downward stroke, the hammer piston shifts to an exhaust condition. During the downward shifting of the hammer piston on its power stroke, the air therebelow is compressed to some extent, but despite the presence of such compressed air, which remains after the hammer piston opens its exhaust passage before the piston impacts upon the anvil, a continuing supply of inlet air pressure acts over a portion of the hammer piston area to assist in driving the hammer piston downwardly against the anvil and against the resistance of the air compressed below the hammer piston. Accordingly, a greater blow is struck against the hammer piston than in prior devices.

Through use of applicant's invention, a far greater horsepower is deliverable for the same inlet air pressure. Moreover, applicant's apparatus can be made substantially shorter (for example, 7 to 9 inches shorter) than prior devices, which offers advantages in using the apparatus on some types of drilling rigs. The horsepower or energy delivered by applicant's air hammer can be further increased by causing the hammer piston to act upon a spring device at the upper end of its stroke, which shortens the travel of the piston and assists in initiating its downward stroke in an anvil impacting direction.

This invention possesses many other advantages, and has other purposes which may be made more clearly apparent from a consideration of several forms in which it may be embodied. Such forms are shown in the drawings accompanying and forming part of the present specification. They will now be described in detail, for the purpose of illustrating the general principles of the invention; but it is to be understood that such detailed description is not to be taken in a limiting sense.

Referring to the drawings:

FIGS. 1*a* and 1*b* together constitute a longitudinal section through an apparatus embodying the invention, with parts in their relative positions in which the hammer piston has completed delivering an impact blow against the companion anvil bit, FIG. 1*b* being a lower continuation of FIG. 1*a;*

FIGS. 2*a* and 2*b* are views similar to FIGS. 1*a* and 1*b*, with the hammer piston approaching its upper position, FIG. 2*b* being a lower continuation of FIG. 2*a;*

FIGS. 3*a* and 3*b* are views similar to FIGS. 1*a* and 1*b*, illustrating the relationship of parts when the drill bit has been elevated from the bottom of the hole, allowing air to be circulated through the apparatus, FIG. 3*b* being a lower continuation of FIG. 3*a;*

Figure 1A:
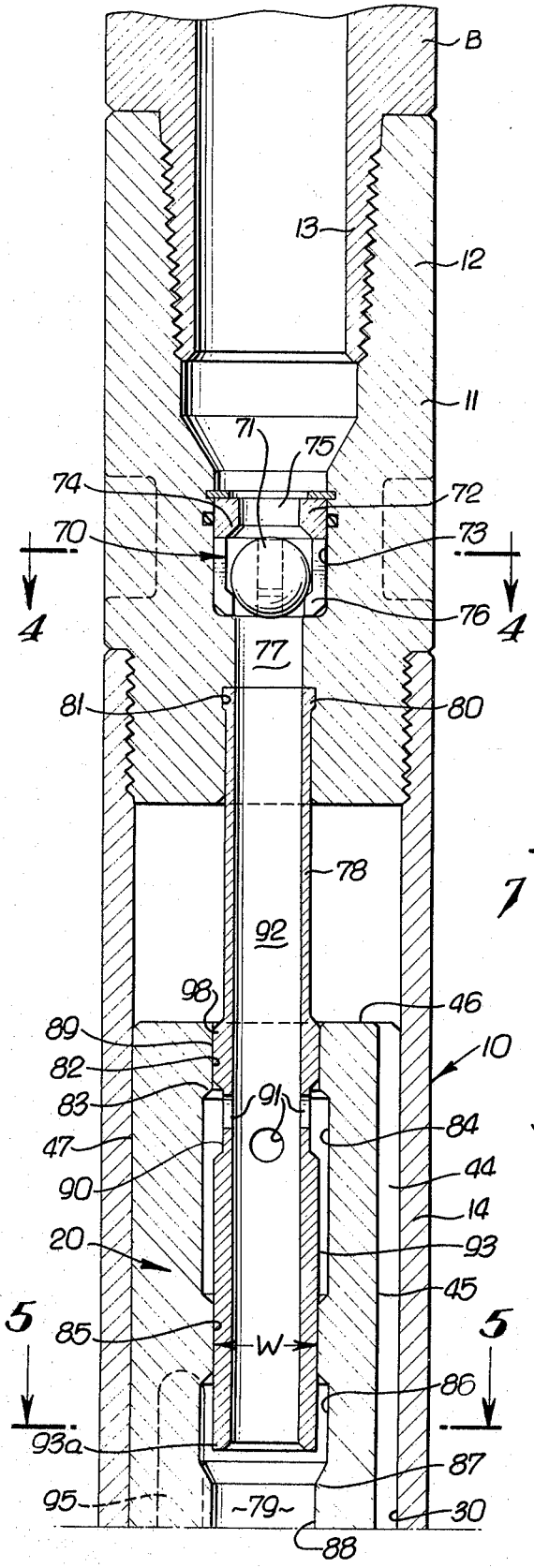

As shown in the drawings (FIGS. 1 to 6), an air hammer apparatus A is provided that is secured to the lower end of a string of drill pipe B, by means of which the apparatus is rotated to correspondingly rotate an impact anvil bit C used for drilling a bore hole D, the apparatus delivering repeated impact blows upon the anvil bit by forcing compressed air down the drill pipe for actuating the apparatus and for cleaning the cuttings from the bottom E of the hole. The apparatus is relatively simple, consisting of an elongate housing structure 10 that includes an upper sub 11 having an upper threaded box 12 (or threaded pin, not shown) for threaded attachment to the lower end 13 of the string of drill pipe, that extends to the drilling rig (not shown) at the top of the bore hole D. This sub is threadedly secured to the upper portion of an elongate housing section 14, which can be of one piece, the lower end of which is threadedly secured to a lower housing head or drive member 15, the lower end 16 of the housing section bearing against an upwardly facing shoulder 17 formed on the head.

An elongate anvil portion 18 of the anvil bit C is piloted upwardly within the drive member 15 and lower portion 19 of the housing section 14, a hammer piston 20 being reciprocable in the housing section above the anvil 18 to deliver repeated impact blows thereagainst. The anvil is preferably formed integrally with the drill bit portion 21 of the anvil bit, which has suitable cutting elements 22 (such as sintered carbide buttons) mounted in its drilling face 23 for impacting against the bottom E of the bore hole, to produce cuttings therein, the cutting elements 22 also acting against the side of the bore hole adjacent to its bottom to insure the production of a bore hole D of the desired diameter.

During the reciprocation of the hammer piston 20 in the housing to deliver impact blows upon the anvil bit, the drill pipe string B and housing structure 10 are rotated at a desired speed, such as 20 r.p.m., to correspondingly rotate the anvil bit C and insure an impacting action of the cutting members 22 over substantially the entire cross-sectional area of the bottom E of the hole. During the impacting action, suitable drilling weight is imposed on the anvil bit through the drill pipe string B and the housing structure 10, such drilling weight being transferred from the lower end 24 of the housing head or drive member 15 to an upwardly facing shoulder 25 of the bit 21. The rotary drive itself is transferred from the housing structure 10 to the anvil 18 through a suitable spline type of connection 26, which can assume several different forms, the particular drive connection illustrated constituting no portion of the present invention. The specific drive connection is illustrated in the application of Alfred R. Curington and Archer W. Kammerer, Jr., for "Bore Hole Air Hammer Drive Mechanism," Ser. No. 239,047, filed Mar. 29, 1972, to which attention is directed.

Figure 7:
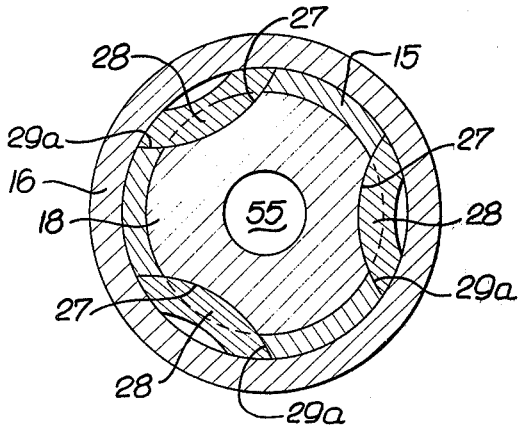
FIG. 7 is a cross-section taken along the line 7—7 on FIG. 1*b.

In general, the upper portion of the anvil has circumferentially spaced elongate chordal surfaces 27 (FIG. 7), which are preferably concave in shape, against which correspondingly shaped segments 28 bear, these segments being carried in circumferentially spaced windows 29 in the drive member 15. The chordal surfaces 27 are substantially longer than the length of the segments 28, permitting relative longitudinal movement of the anvil bit C with respect to the housing structure 10. The rotary effort is transferred from the housing section 14 to the drive member 15 by virtue of the threaded connection 30*d*, and from the sides 29*a* of the openings 29 to the segments 28, from where the turning effort is transmitted through the abutting segment and anvil surfaces 27*a*, 27 to the anvil bit C.

The housing section 14 includes an elongate upper inner cylindrical housing wall 30, the lower end 31 of which constitutes an upper housing flow control corner at the upper end of an elongate internal circumferential exhaust groove 32 of a substantially larger internal diameter than the diameter of the inner cylindrical housing wall 30. Below the lower end 33 of the exhaust groove, the housing section is provided with a lower inner cylindrical housing wall 34, which may be of the same internal diameter as the upper housing wall 30, the upper end of the lower wall being the housing lower flow control corner 33. The lower end 35 of the lower inner cylindrical housing wall 34 provides a by-pass corner at the upper end of an enlarged internal diameter circumferential by-pass groove 36.

The elongate hammer piston 20 includes an upper piston portion 37 having an external diameter 37*a* conforming to the diameter of the upper inner cylindrical housing wall 30, this upper piston portion terminating at the upper end 38 of an external circumferential exhaust groove 39 of a lesser external diameter than the upper piston portion 37. This external exhaust groove terminates at a lower piston portion 40 having an external diameter conforming to the internal diameter of the lower inner cylindrical housing wall 34. Below its lower piston portion, the hammer is of a reduced external diameter 41, providing a downwardly facing shoulder 42 which may, upon removal of the anvil bit C from the housing 10, engage a limit ring 43 mounted in the housing section 14, to prevent the piston 20 from inadvertently dropping out of the housing structure. The hammer piston extends upwardly to a substantial distance above its upper piston portion 37, having a plurality of circumferentially spaced relief portions 44 (FIG. 5) which may be formed by elongate chords 45 in the hammer portion extending from the upper piston portion 37 to the upper end 46 of the latter, there being circumferentially spaced elongated arcuate sections 47 between the relief portions 44 having the same external diameter as the upper piston portion 37 and assisting in guiding the hammer piston 20 in its reciprocation along the inner wall of the housing section 14.

Figure 1B:
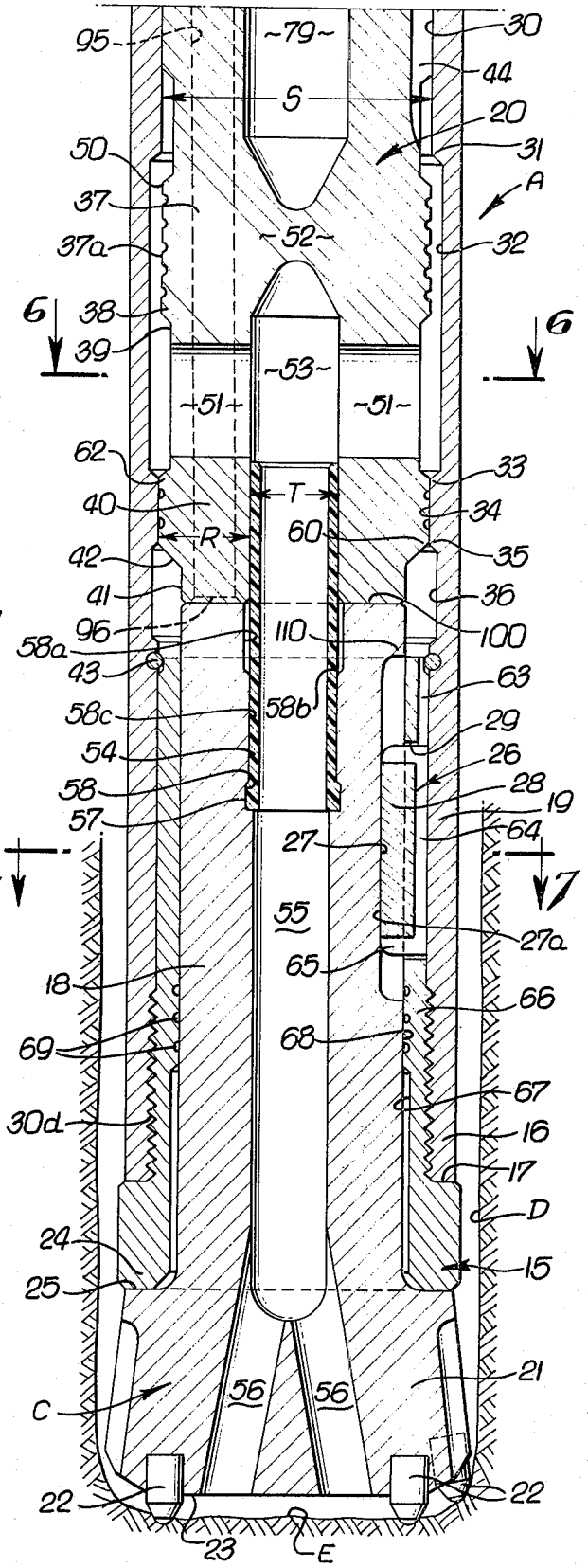

As described hereinbelow, when the hammer piston 20 is at the lower end of its stroke, as shown in FIGS. 1*a*, 1*b*, a flow control piston corner 50 at the upper end of the piston portion 37 is spaced below the upper housing flow control corner 31, allowing air in the housing above the piston 20 to flow down through the passages 44 and into the internal circumferential exhaust groove 32, around the upper piston portion 37, then into radial exhaust ports 51, formed through the hammer piston below its intermediate piston wall 52, that communicate with an elongate central piston cavity 53 into which an exhaust tube 54 extends upwardly from the anvil 18, the tube forming a continuation of the exhaust passage 53 and communicating with an exhaust passage 55 through the anvil and one or a plurality of exhaust passages 56 extending downwardly through the bit 21 and opening outwardly thereof for the purpose of removing the cuttings from the bottom E of the hole. The tube 54 makes a slidable seal with the wall 53*a* of the piston cavity 53, being secured to the anvil 18 by a lower outwardly extending tube flange 57 being received within an inner circumferential groove 58 in the anvil. The tube may be made of an elastic material, such as Delrin, which permits it to be inserted within the anvil passage, the flange 57 contracting sufficiently until it is opposite the circumferential groove 58, whereupon the tube flange can snap outwardly into the groove 58 and thereby lock the tube 54 to the anvil 18.

When the piston 20 is shifted upwardly within the housing on its return stroke, the return air corner 60 at the lower end of the piston portion 40 will be disposed above the housing lower flow control corner 33 (FIGS.

2*a*, 2*b*), whereupon the compressed air below the piston can exhaust into the internal circumferential housing groove 32 and flow through the exhaust ports 51 and exhaust passages 53, 55, 56 to the bottom E of the bore hole. At this time, the upper flow control piston corner 50 will be disposed above the upper housing flow control corner 31, which will seal the upper piston portion 37 against the upper inner cylindrical housing wall 30, whereupon compressed air can drive the piston 20 downwardly on its hammer or power stroke. When the return air corner 60 moves below the housing lower flow control corner 33, the air below the piston and within the housing, which remains after the lower piston portion 40 is closed within the lower end of the cylindrical housing wall 34, is subject to compression, but such air will be at a relatively low pressure.

Figure 3A:
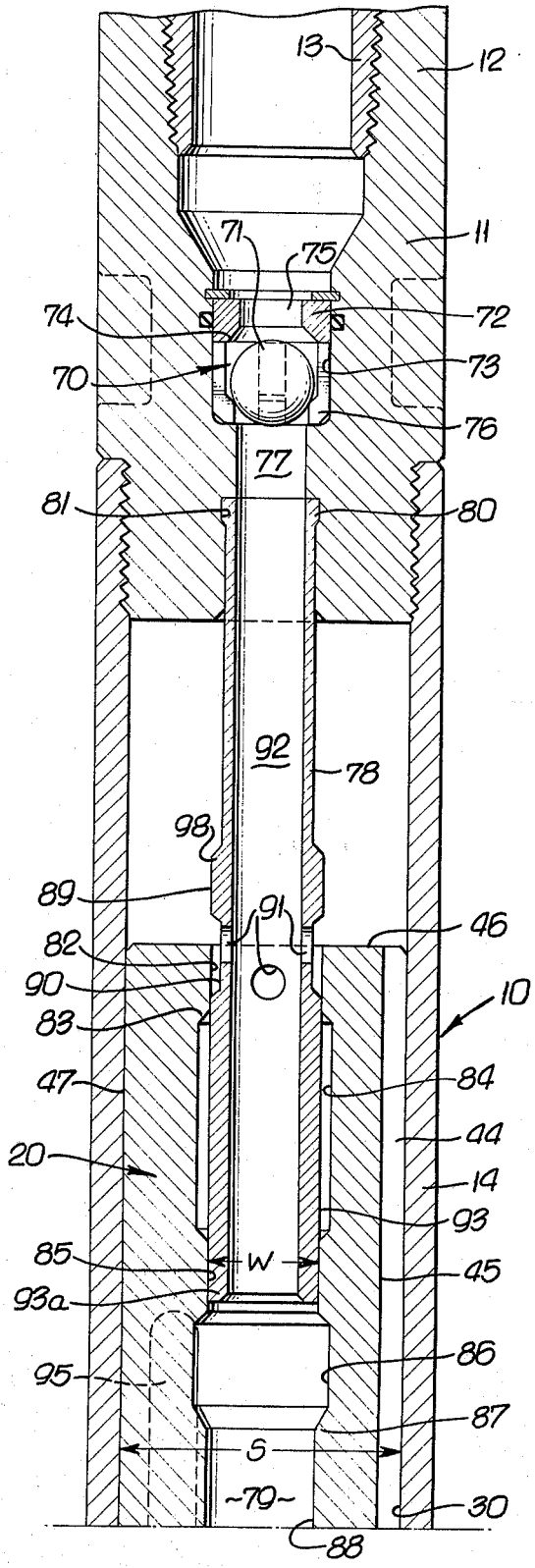
Figure 3B:
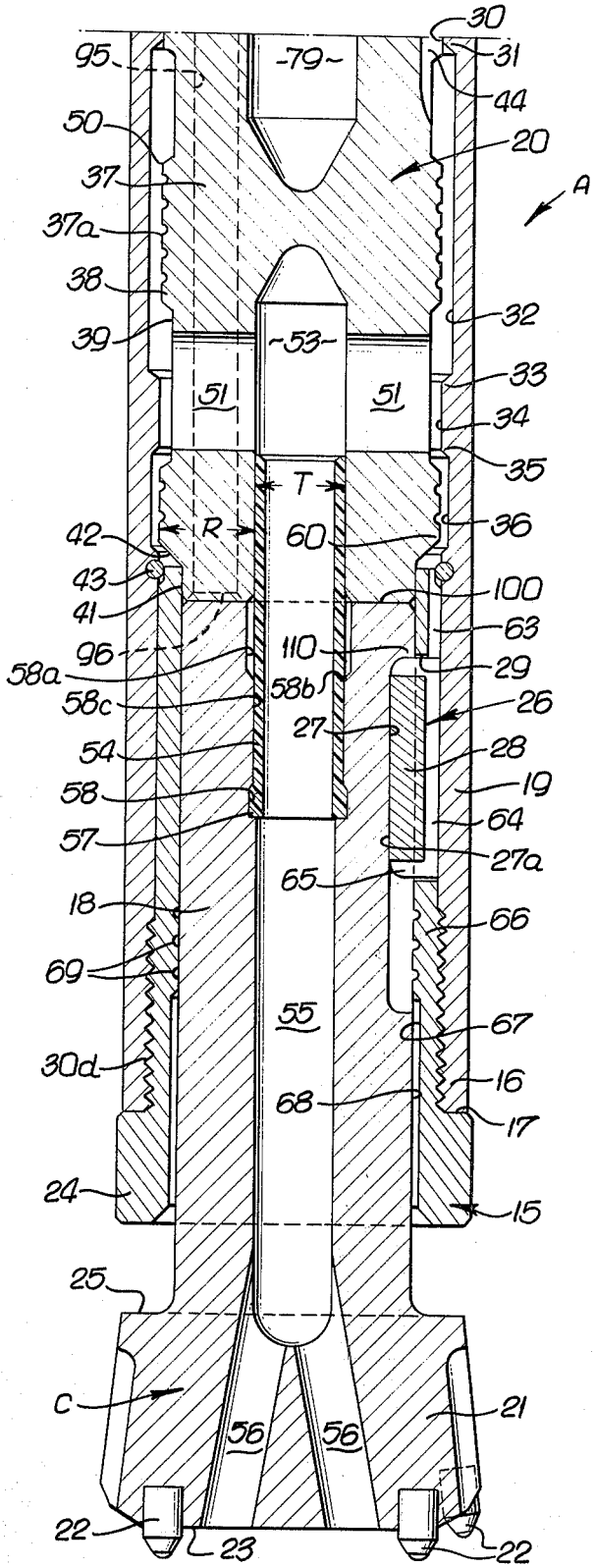
Figure 5:
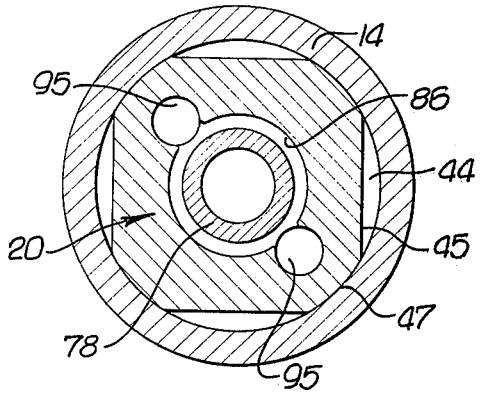
FIG. 5 is a cross-section taken along the line 5—5 on FIG. 1*a;*
Figure 6:
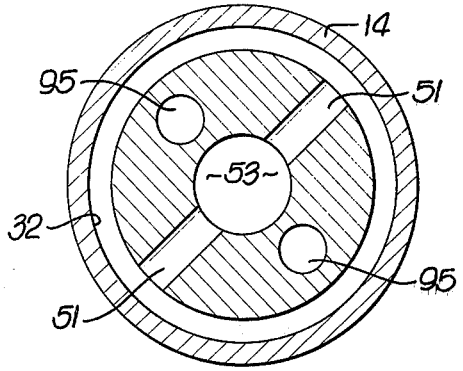
FIG. 6 is a cross-section taken along the line 6—6 on FIG. 1*b;*

As described hereinbelow, in the event the apparatus is elevated to raise the bit 21 from the bottom E of the hole, the latter will drop downwardly until its upper anvil head flange 110 engages the upper ends of the segments or keys 28. This will allow the upper piston by-pass corner 62 to shift below the housing by-pass corner 35 at the lower end of the lower inner cylindrical housing wall 34, the upper flow control piston corner being well below the upper housing flow control corner (FIGS. 3*a*, 3*b*). Accordingly, compressed air above the piston can flow through the passages 44 and the internal circumferential exhaust groove 32 into the air by-pass groove 36 below the lower housing wall 34, the air passing downwardly through the passages 63 in the upper portion of the anvil rotary drive member 15 and into the by-pass passages 64 between the segments and the surrounding housing wall, flowing through the lower slots 65 in the segments and into the concave cavities 27 in the anvil 18, the air flowing past a head sealing portion 66 within the drive member 15 and into elongate relief grooves 67 extending downwardly through the lower end of the drive member 15. When the anvil 18 is in its upper position within the housing and with the bit shoulder 25 engaging the lower end 24 of the drive member 15, the head sealing portion 66 seals against the periphery 68 of the anvil below its elongate grooves 27 in which the segments or keys 28 are positioned. To facilitate such sealing, the head portion 66 may have a plurality of longitudinally spaced internal labyrinth seal grooves 69 formed therein.

Compressed air for reciprocating the hammer piston 20 passes downwardly through the string of drill pipe B and into the upper housing sub 11, flowing past a downwardly opening check valve 70 which may be in the form of a ball 71 received within a valve body 72 mounted in a counterbore 73 in the sub, the ball being movable upwardly to engage a companion seat 74 surrounding a central passage 75 through the body, the downward movement of the ball being limited by its engagement with circumferentially spaced feet 76 extending inwardly from the body. With air being pumped downwardly through the apparatus, the ball 71 engages the feet 76 and the air can flow around the ball and between the feet and into a central passage 77 in the housing sub.

The inlet air under pressure is caused to flow alternately into the housing below the piston 20 and the housing above the piston, to effect reciprocation of the hammer piston. A housing inlet tube 78 is mounted in the sub passage 77, projecting downwardly from the sub or head 11 and into an upper elongate central piston cavity or chamber 79 above the intermediate piston wall 52, which separates the upper chamber 79 from the lower chamber 53. The tube 78 is secured in the sub by an upper external flange 80 on the tube fitting within a companion internal circumferential groove 81 in the sub. The inlet tube is made of a flexible material, such as Delrin, which permits the upper portion of the tube to be deflected inwardly of the sub passage 77 below the circumferential groove 81, and when the flange 80 becomes aligned with the groove, the latter inherently expands outwardly into the groove to secure the tube to the sub 11. The elastic nature of the tube is such that it also provides a slidable seal with the inner walls of the piston 20, as explained hereinbelow.

The piston has an elongate upper cylindrical surface 82 opening through its upper end 46 and terminating at an inner, upper flow control piston corner 83, which is the upper end portion of an elongate internal circumferential impact passage groove 84 having a substantially larger internal diameter than the inside diameter of the upper piston portion 82. The circumferential impact passage groove 84 terminates at an intermediate inner cylindrical piston wall 85, which may have the same internal diameter as the upper cylindrical piston wall 82, the intermediate wall terminating at an internal circumferential return passage groove 86 formed in the piston and terminating at a lower flow control piston corner 87, which is the upper end of a lower internal piston seal portion 88 that extends upwardly from the intermediate piston wall 52. The inlet tube 78 has an upper external cylindrical sealing surface 89 relatively slidably sealable with the upper piston wall 82 and terminating in an external circumferential inlet groove 90 communicating with radial inlet ports 91 that open to the central inlet passage 92 through the tube. Below this circumferential inlet groove 90, the tube is formed as a lower cylindrical sealing surface 93 slidably and sealingly engageable with the intermediate inner cylindrical piston wall 85 and also with the lower piston wall 88.

Figure 2A:
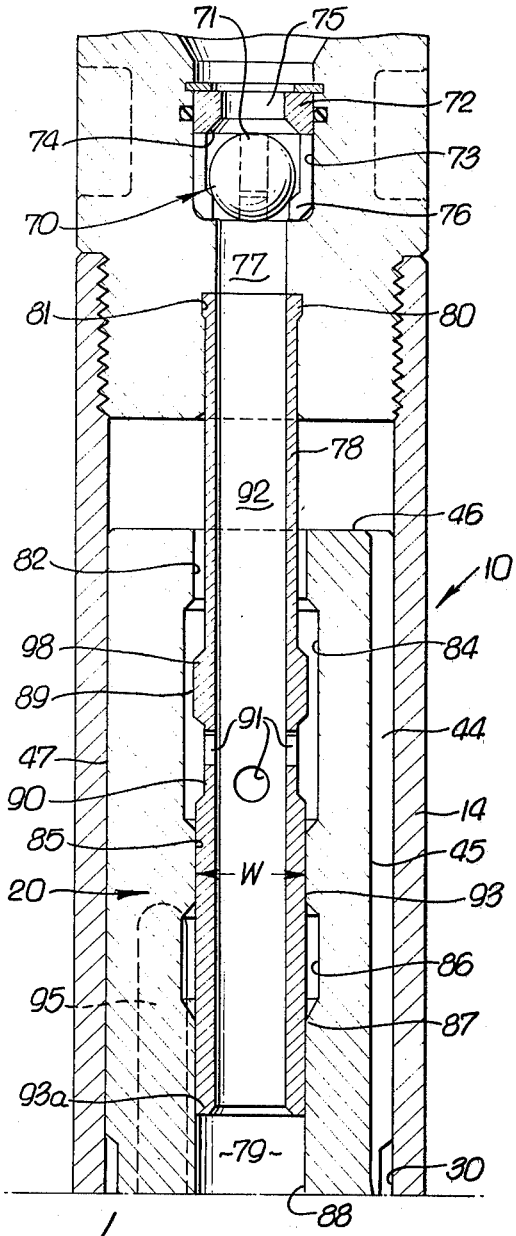
Figure 2B:
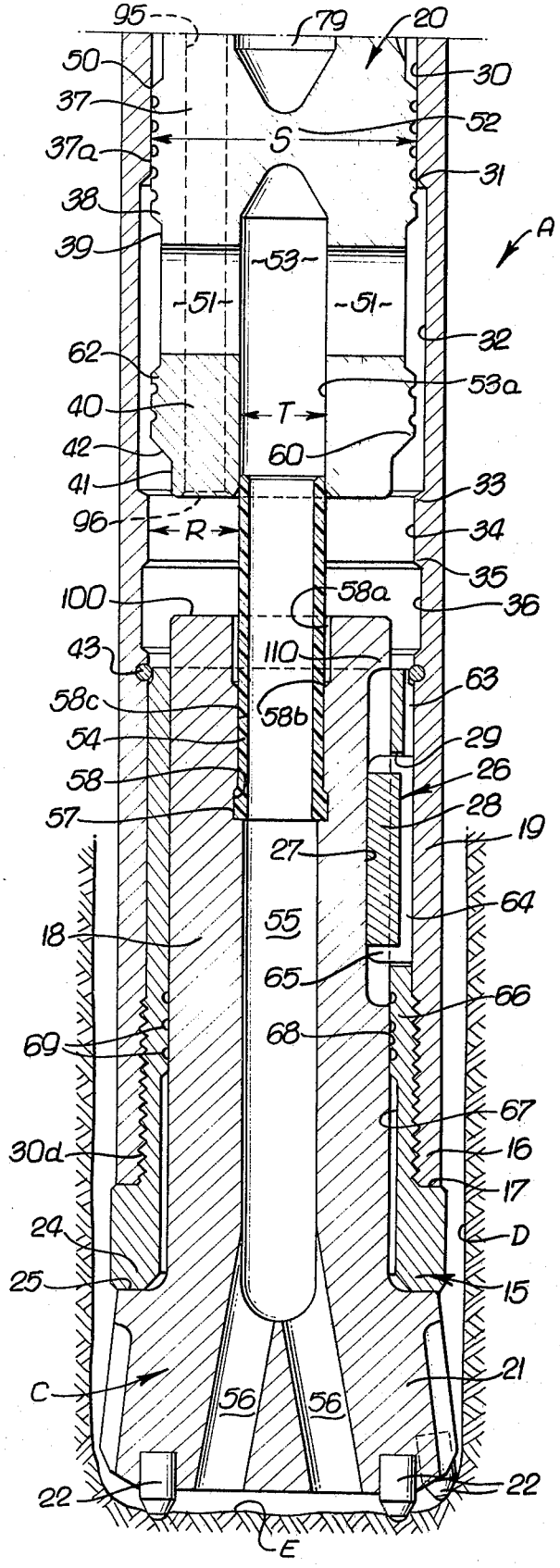
Figure 4:
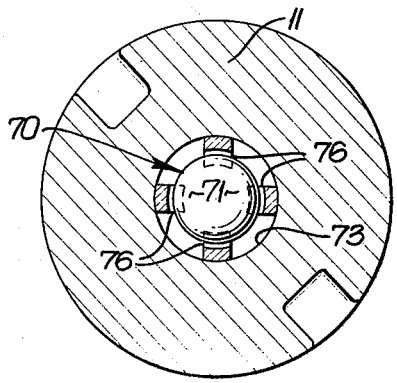
FIG. 4 is a cross-section taken along the line 4—4 on FIG. 1*a;*

When the piston 20 is in its lowermost operative position, with the drill bit 21 pressed against the bottom E of the bore hole D, compressed air can flow downwardly through the inlet passage 92, discharging into the circumferential return passage 86 that communicates with the upper portion of one or more longitudinal return passages 95 extending downwardly through the hammer piston and opening outwardly through its lower end 96. When the hammer piston 20 moves upwardly within the housing 10 and along the inlet tube 78, the lower flow control piston corner 87 first shifts upwardly over the lower flow control housing tube corner 93a to disrupt communication between the inlet passage 92 and the return passage 95, continued upward movement of the piston then placing the inner upper flow control piston corner 83 above the upper flow control housing tube corner 98, which then allows compressed air to flow from the inlet passage 92 through the ports 91 into the circumferential inlet groove 90 into the internal circumferential impact passage groove 84 and thence into the housing above the upper end 46 of the piston (FIGS. 2*a*, 2*b*). At this time, the upper piston portion 50 will have moved partially above the upper housing flow control corner 31, so that the air under pressure between the upper end 46 of the piston and the housing sub or head 11 can act downwardly on the piston, urging it in a downward direction.

The piston 20 will be shifted downwardly until the upper flow control piston corner 83 moves below the flow control housing tube corner 98, which shuts off air pressure into the housing above the piston, the piston continuing to move downwardly, as the compressed air expands, until the outer upper flow control piston corner 50 moves below the upper housing flow control corner 31, which then permits air above the piston to pass through the passages 44 into the internal circumferential exhaust grooves 32, and through the exhaust ports 51 and exhaust passages 53, 55, 56 to the bottom of the hole below the drill bit, the hammer piston being driven against the upper face 100 of the anvil to deliver an impact blow to the impact bit C. As the piston nears the end of its downward stroke, the lower flow control piston corner 87 will move below the lower flow control housing tube corner 93a, thereby allowing the compressed air to flow from the inlet passage 92 into the upper piston cavity 79 and internal circumferential return passage groove 86, passing downwardly through the longitudinal return passages 95 to the lower end of the piston, such air then moving the piston in an upward direction, until the lower flow control piston corner 87 passes upwardly beyond the lower flow control housing tube corner 93*a* once again. to shut off the flow of air into the return passages 95. When this occurs, the outer upper flow control piston corner 50 moves above the upper housing flow control corner 31 to shut off the exhaust of air from the housing region above the piston 20, the compressed air below the piston expanding and driving the hammer piston upwardly toward the head 11 of the housing. Before reaching the head 11, the inner upper flow control piston corner 83 will have shifted upwardly along the tube 78 to a position above the upper flow control housing tube corner 98, allowing air under pressure to pass from the inlet passage 92 through the impact passage grooves 90, 84 to a position in the housing above the piston 20.

The upward travel of the piston 20 is cushioned by the compression of the air remaining in the housing above the piston. However, the piston will still move upwardly sufficiently to place the lower corner 60 of the lower piston portion 40 above the housing lower flow control corner 33, which then permits the compressed air below the piston to travel into the internal circumferential exhaust groove 32 and through the exhaust ports 51 into the exhaust passages 53, 55, 56 for discharge from the drill bit. The compressed air in the housing structure above the piston then expands to drive the piston downwardly, and the foregoing cycle of operation is repeated, the piston reciprocating to deliver repeated impact blows against the anvil portion 18 of the anvil bit C, while the drill string B and the entire apparatus A is being rotated, to insure that the drilling or cutting elements 22 will cover substantially the entire cross-sectional area of the bore hole bottom E.

In the event it is desired to pump compressed air through the apparatus while the anvil bit 21 is off bottom, elevation of the apparatus A will cause the impact bit C to drop downwardly along the housing until the upper anvil head 110 engages the upper ends of the keys 28. The piston 20 will also drop downwardly until its by-pass corner 62 is below the by-pass corner 35 of the housing 10, the upper corner 62 of the piston being disposed below the upper end of the internal circumferential groove 36 (FIGS. 3*a*, 3*b*). Accordingly, compressed air flowing downwardly through the drill string B and into the inlet passage 92 can pass through the inlet ports 91 and upwardly between the tubing and the upper seal portion 82 to a position above the piston, then flowing downwardly through the passages 44 and into the internal circumferential exhaust groove 32, flowing between the external circumferential exhaust groove 39 in the piston and the opposed lower inner cylindrical housing wall 34 into the enlarged diameter groove 36 below the inner cylindrical housing wall, then passing through the passages 63, 64, 65, 67 to the exterior of the bit 21. Since the path just described is open, compressed air cannot remain below the piston 20, which might otherwise tend to cause the piston to continue reciprocating and cycling in the housing 10. It is also evident that the compressed air being pumped through the apparatus will also flow through the exhaust ports 51 and the exhaust passages 53, 55, 56 and downwardly through the anvil bit C.

When the piston 20 is on its power stroke, air will be compressed below the piston, as pointed out above, because of the sealing of the lower piston portion 40 against the lower inner cylindrical housing wall 34 and the sealing of the head portion 66 against the periphery of the anvil 18. However, air under pressure is always present within the upper central piston cavity or chamber 79, acting over the cross-sectional area W of such chamber, and continuing to exert its force to overcome the pressure acting upwardly over the piston and tending to elevate it (FIGS. 1*a*, 1*b*). Thus, the hammer piston 20 will strike its impact blow upon the upper end 100 of the anvil with a greater force, in view of the overcoming of a portion of the resisting force offered by the compressed air acting upwardly over the cross-sectional area R across the lower portion of the piston, such area existing between the periphery of the exhaust tube 54 and the lower inner cylindrical housing wall 34.

On its power stroke, the compressed air acts over the full cross-sectional area S of the upper piston portion, which is the same area as the area across the inner cylindrical housing wall 30. It is acting downwardly over the cross-sectional area of the piston between the periphery of the upper flow control tube and the upper inner cylindrical housing wall 30, and also over the area W across the central piston cavity or chamber 79. During the return stroke, the compressed air is acting upwardly over the piston over the area R, which is less than the full cross-sectional area S, but such full area is not needed for the purpose of returning the piston under comparatively little load toward the upper end of its stroke.

The apparatus shown and described, at the same unit air pressure, operates at an increased frequency and delivers a considerably greater horsepower than prior air hammers. Moreover, the apparatus is comparatively economical to manufacture, since the elongate housing section 14 is of a single piece, with a single external diameter. It is merely necessary to form the different internal diameter portions to the required dimensions on relatively simple equipment, such as a lathe. Similarly, the piston 20 is economical to manufacture, requiring relatively simple equipment, the longitudinal return passages 95 being easily drilled, the drilling action automatically communicating the upper ends of the passages 95 with the internal circumferential return passage groove 86. The tubes 78, 54 are readily formed and mounted in place, being made of the elastic material, such as Delrin, the upper inlet ports 91 being easily formed in the upper tube 78.

Figure 8:
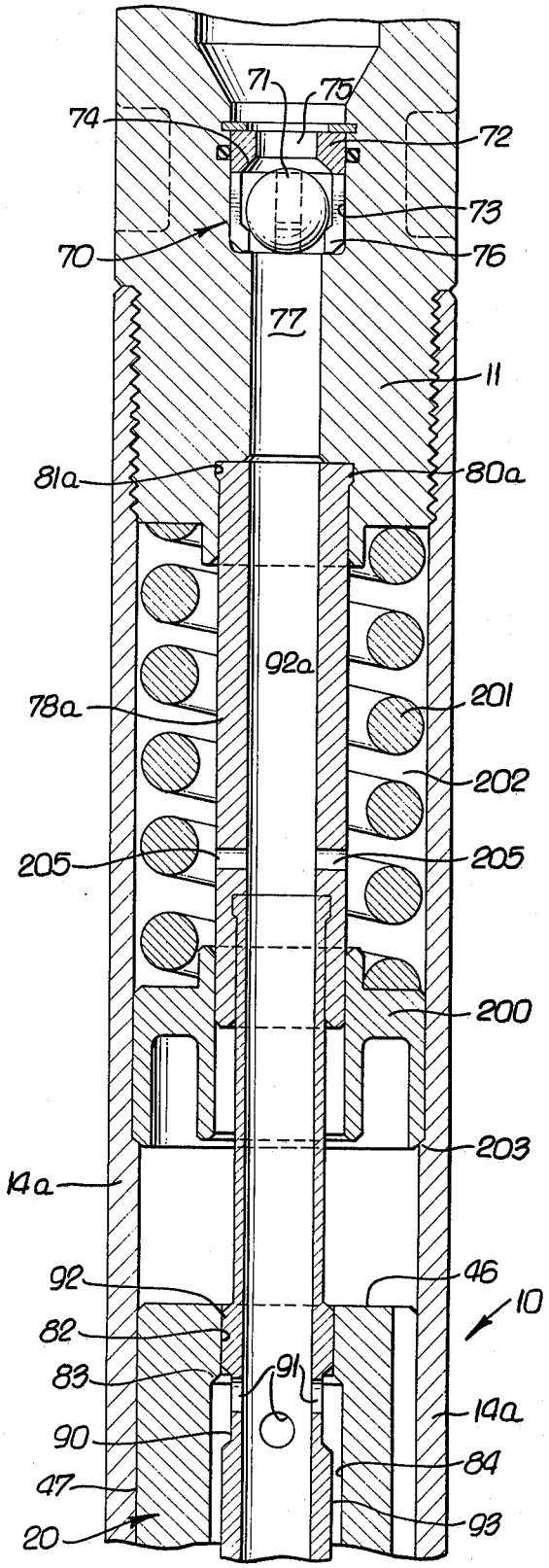
* and FIG. 8 is a view similar to FIG. 1*a* illustrating a modified portion of the apparatus.

In the form of invention illustrated in FIG. 8, the upper travel of the piston 20 is limited by its engagement with a spring seat 200 slidably sealed within the upper portion of the housing section 14*a*, which also is slidably engageable with the lower portion of an inlet tube extension 78*a*, to the lower end of which the inlet tube 78 is connected, this inlet tube extension being fastened in the housing sub 11 in the same manner as the tube 78 in the other form of the invention; namely, by the reception of its flange 80*a* within the circumferential groove 81*a*. The inlet tube extension 78*a* can also be formed of an elastic material, such as Delrin.

A helical compression spring 201 is disposed in the chamber or space 202 between the inlet tube extension 78*a* and the upper portion of the housing section 14*a*, which is threadedly secured to the upper housing sub 11, the lower end of this spring engaging the spring seat 200 and its upper end engaging the housing sub 11. The compressed spring urges the spring seat 200 downwardly to the limit of its travel, as determined by engagement of its lower end with an upwardly facing shoulder 203 formed in the housing section 14*a*.

Compressed air is always present in the spring chamber 202, acting downwardly on the spring seat 200, this compressed air supplementing the force of the helical compression spring 201 tending to hold the spring seat 200 against its companion shoulder 203. Such compressed air can flow from the central passage 92*a* in the inlet tube extension through radial ports 205 into the spring chamber.

The operation of the apparatus embodying the yieldable spring is essentially the same as in the other form of the invention. With the spring present, the piston 20 has a shorter travel on its upward or return stroke, engaging the spring seat 200 and shifting it upwardly against the force of the helical compression spring 201. The spring force assists in initiating the downward travel of the hammer piston, adding its force to the air pressure in driving the hammer piston downwardly on its power stroke. With the arrangement noted, a still greater increase in the horsepower deliverable by the apparatus is noted than in the other form of the invention. The frequency of operation is increased to still a further extent. Computations run on the designs illustrated in the drawings show that the horsepower capable of being developed in the system without the spring feature results in an increase of about 37% over prior art devices; whereas, with the spring assister, the increased horsepower calculates at about a 61% increase over prior art air hammer devices.

As described above, the exhaust tube or sleeve 54 is made of an elastic material, which is a suitable synthetic resin such as Delrin. This sleeve must make a slidable seal with the wall 53*a* of the piston cavity 53 to prevent or minimize leakage of air between the tube and the wall 53*a*. Because of manufacturing tolerances, a perfect alignment between the hammer piston 20 and the anvil 18 may not exist. Accordingly, as the piston approaches the anvil and impacts thereagainst, it imposes a lateral force on the exhaust sleeve 54. If the exhaust tube made a close fit with the wall 58*c* of the anvil downwardly from its upper face 100, even a small amount of misalignment between the piston 20 and the anvil would cause a high shearing stress to be imposed on the exhaust tube 54, resulting in fatigue failure of the exhaust tube after a relatively short period of use of the apparatus.

The above difficulty is overcome in the apparatus illustrated by providing relief between the exterior of the exhaust tube or sleeve 54 and the wall 58*c* of the anvil 18, such relief extending downwardly from the upper anvil face 100. As shown, a counterbore 58*a* is provided in the anvil that extends downwardly from its upper face 100 to a substantial extent, which, by way of example, is of the order of about one inch. In view of the counterbore, any misalignments between the piston 20 and the anvil 18 will prevent the high shearing stresses from occurring on the tube substantially in the plane of the upper face 100 of the anvil. Instead, the exhaust sleeve 54 can readily flex or bend about the base 58*b* of the counterbore, which acts as a fulcrum point, particularly in view of an elastic material from which the exhaust sleeve 54 is made. The bending stresses to which the tube 54 is subjected as a result of misalignment between the piston 20 and the anvil 18 are maintained at a comparatively low value, which prevents the exhaust sleeve 54 from fatigue failure.

Although the counterbore 58*a* has been provided to permit the bending of the sleeve 54, a corresponding result can be achieved by maintaining the wall 58*c* of the anvil cylindrical from its upper face 100 downwardly, and by providing the relief in the exterior of the exhaust sleeve 54 itself. Thus, the outside diameter of the exhaust sleeve would be reduced slightly in a downward direction from substantially the plane of the upper face 100 to a substantial extent, which, as presented in the above example relating to the counterbore, would be of the order of about one inch. The high shearing stresses on the sleeve 54 substantially in the plane of the upper face 100 would be eliminated, the sleeve 54 being subjected to the relatively low bending stresses, as a result of misalignment, that might occur between the piston 20 and the anvil 18.

I claim:

1. In percussion drilling apparatus: a housing structure connectable to a drill string; an anvil in the lower portion of said housing structure and operatively connectable to a drill bit; a hammer piston reciprocable in said housing structure for intermittently impacting against said anvil, said piston having an upper passage; inlet means for directing a fluid medium under pressure into said passage, first means for directing the fluid medium from said passage into said housing structure above said piston upon upward movement of said piston in said housing structure for driving said hammer piston downwardly toward said anvil; second means for directing the fluid medium from said passage into said housing structure below said piston upon downward movement of said piston in said housing structure for elevating said piston in said housing structure; means for alternately exhausting the fluid medium from the housing structure above and below said piston; said piston including means substantially closing the lower portion of said passage; said inlet means comprising means opening into said passage above said piston passage closing means for conducting the fluid medium under pressure directly into said passage for action against said piston passage closing means during the entire downward stroke of said piston toward and against said anvil; whereby the fluid medium under pressure acts concurrently over substantially the full cross-sectional area of said piston in driving said piston downwardly toward said anvil.

2. In apparatus as defined in claim 1; said inlet means and piston having coengaging valve means thereon opening said first means and closing said second means upon upward movement of said piston in said housing structure and closing said first means and opening said second means upon downward movement of said piston in said housing structure.

3. In apparatus as defined in claim 1; said inlet means and piston means coengaging valve means thereon opening said first means and closing said second means upon upward movement of said piston in said housing structure and closing said first means and opening said second means upon downward movement of said piston in said housing structure; said exhausting means including exhaust passage means in said piston through which the exhaust fluid medium passes alternately from said housing structure above and below said hammer piston, said exhausting means further including coengaging valve means on said piston and housing structure for controlling said alternate passage of the exhaust fluid medium.

4. In apparatus as defined in claim 1; and spring arresting means bearing against said housing structure and hammer piston to receive energy from said piston on the upstroke of said piston and to return such energy to said piston to force said piston downwardly in said housing structure.

5. In apparatus as defined in claim 1; said first means being provided between said inlet means and upper piston passage and opening centrally through the upper end of said upper passage into said housing structure above said piston.

6. In percussion drilling apparatus: a housing structure connectable to a drill string; an anvil in the lower portion of said housing structure and operatively connectable to a drill bit; a hammer piston reciprocable in said housing structure for intermittently impacting against said anvil, said piston having a central upper chamber therein; an inlet tube piloted in said chamber and adapted to receive a fluid medium under pressure from the drill string and direct such fluid medium into said chamber; first passage means for directing the fluid medium from said chamber into said housing structure above said piston; second passage means for directing the fluid medium from said chamber into said housing structure below said piston; coengaging valve means on said tube and piston wall of said chamber opening said first passage means and closing said second passage means upon upward movement of said piston in said housing structure and closing said first passage means and opening said second passage means upon downward movement of said piston in said housing structure; means alternately exhausting the fluid medium from the housing structure above and below said piston; said piston including means substantially closing the lower portion of said upper chamber; said inlet tube having a lower passage opening into said upper chamber above said piston chamber closing means through which the fluid medium is discharged directly into said upper chamber for action against said piston chamber closing means during the entire downward stroke of said piston toward and against said anvil; whereby the fluid medium under pressure acts concurrently over substantially the full cross-sectional area of said piston in driving said piston downwardly toward said anvil.

7. In apparatus as defined in claim 6; said exhausting means including exhaust passage means through which the exhaust fluid medium passes alternately from said housing structure above and below said hammer piston, said exhausting means further including coengaging valve means on said piston and housing structure for controlling said alternate passage of the exhaust fluid medium from the housing structure above and below said piston.

8. In apparatus as defined in claim 6; said exhausting means including exhaust passage means through which the exhaust fluid medium passes alternately from said housing structure above and below said hammer piston, said exhausting means further including coengaging valve means on said piston and housing structure for controlling said alternate passage of the exhaust fluid medium from the housing structure above and below said piston; said exhausting means further including intercommunicating exhaust passages in said anvil and lower portion of said piston and communicable with said exhaust passage means under the control of said valve means on said piston and housing structure.

9. In apparatus as defined in claim 6; and spring arresting means bearing against said housing structure and hammer piston to receive energy from said piston on the upstroke of said piston and to return such energy to said piston to force said piston downwardly in said housing structure.

10. In apparatus as defined in claim 6; said first passage means being provided between said inlet tube and upper chamber and opening centrally through the upper end of said upper chamber into said housing structure above said piston.

11. In percussion drilling apparatus: a housing structure connectable to a drill string; an anvil in the lower portion of said housing structure and operatively connectable to a drill bit; a hammer piston reciprocable in said housing structure for intermittently impacting againt said anvil, said piston having a central upper chamber therein; an inlet tube piloted in said chamber and adapted to receive a fluid medium under pressure from the drill string and direct such fluid medium into said chamber; first passage means for directing the fluid medium from said chamber into said housing structure above said piston; second passage means for directing the fluid medium from said chamber into said housing structure below said piston; coengaging valve means on said tube and piston wall of said chamber opening said first passage means and closing said second passage means upon upward movement of said piston in said housing structure and closing said first passage means and opening said second passage means upon downward movement of said piston in said housing structure; and means for alternately exhausting the fluid medium from the housing structure above and below said piston; said exhausting means including a first exhaust passage in the lower portion of said piston, a second exhaust passage in said anvil, an exhaust tube in said anvil passage projecting upwardly into said first exhaust passage, and an exhaust passageway in the inner side wall of the housing structure; said piston and housing structure having coengaging valve means for alternately permitting and preventing passage of the exhaust fluid medium from the housing structure above said piston to said exhaust passageway and from the housing structure below said piston to said exhaust passageway.

12. In apparatus as defined in claim 11; said piston having a wall closing said upper chamber from the exhaust passage in the lower portion of said piston.

13. In apparatus as defined in claim 11; said coengaging valve means comprising an upper portion on said piston above said first exhaust passage adapted to seal with the wall of said housing structure above said exhaust passageway upon upward movement of said piston in said housing structure and to shift from sealing relation to said housing structure wall upon downward movement of said piston in said housing structure, said coengaging valve means further comprising a lower portion on said piston below said first exhaust passage adapted to seal with the wall of said housing structure below said exhaust passageway upon downward movement of said piston in said housing structure and to shift from sealing relation to said housing structure wall upon upward movement of said piston in said housing structure.

14. In apparatus as defined in claim 11; said coengaging valve means comprising an upper portion on said piston above said first exhaust passage adapted to seal with the wall of said housing structure above said exhaust passageway upon upward movement of said piston in said housing structure and to shift from sealing relation to said housing structure wall upon downward movement of said piston in said housing structure, said coengaging valve means further comprising a lower portion on said piston below said first exhaust passage adapted to seal with the wall of said housing structure below said exhaust passageway upon downward movement of said piston in said housing structure and to shift from sealing relation to said housing structure wall upon upward movement of said piston in said housing structure; and spring arresting means bearing against said housing structure and hammer piston to receive energy from said piston on the upstroke of said piston and to return such energy to said piston to force said piston downwardly in said housing structure.

15. In apparatus as defined in claim 11; said first passage means being provided between said inlet tube and upper chamber and opening centrally through the upper end of said upper chamber into said housing structure above said piston.

16. In apparatus as defined in claim 11; said piston having a wall substantially closing said upper chamber from the exhaust passage in the lower portion of said piston, said wall effecting substantial closing of said upper chamber to enable the fluid medium under pressure to act concurrently over substantially the full cross-sectional area of said piston.

17. In apparatus as defined in claim 11; said coengaging valve means comprising an upper portion on said piston above said first exhaust passage adapted to seal with the wall of said housing structure above said exhaust passageway upon upward movement of said piston in said housing structure and to shift from sealing relation to said housing structure wall upon downward movement of said piston in said housing structure, said coengaging valve means further comprising a lower portion on said piston below said first exhaust passage adapted to seal with the wall of said housing structure below said exhaust passageway upon downward movement of said piston in said housing structure and to shift from sealing relation to said housing structure wall upon upward movement of said piston in said housing structure.

18. In percussion drilling apparatus: a housing structure connectable to a drill string; an anvil in the lower portion of said housing structure and operatively connectable to a drill bit; a hammer piston reciprocable in said housing structure for intermittently impacting againt said anvil, said piston having a central upper chamber therein; an inlet tube piloted in said chamber and adapted to receive a fluid medium under pressure from the drill string and direct such fluid medium into said chamber; first passage means for directing the fluid medium from said chamber into said housing structure above said piston; second passage means for directing the fluid medium from said chamber into said housing structure below said piston; coengaging valve means on said tube and piston wall of said chamber opening said first passage means and closing said second passage means upon upward movement of said piston in said housing structure and closing said first passage means and opening said second passage means upon downward movement of said piston in said housing structure; and means for alternately exhausting the fluid medium from the housing structure above and below said piston; said exhausting means including a first exhaust passage in the lower portion of said piston, a second exhaust passage in said anvil, an exhaust tube in said anvil passage projecting upwardly into said first exhaust passage, and an exhaust passageway in the inner side wall of said housing structure; said piston and housing structure having coengaging valve means for controlling passage of the exhaust fluid medium alternately from the housing structure above and below said piston to said exhaust passageway in the inner side wall of said housing structure; a third exhaust passage in said piston providing communication between said exhaust passageway and said first exhaust passage to enable the exhaust fluid medium flowing from above and below said piston to pass from said exhaust passageway through said third exhaust passage and through said first exhaust passage into said second exhaust passage in said anvil.

* * * * *

UNITED STATES PATENT OFFICE

CERTIFICATE OF CORRECTION

PATENT NO. : 3,944,003
DATED : March 16, 1976
INVENTOR(S) : ALFRED R. CURINGTON

It is certified that error appears in the above-identified patent and that said Letters Patent are hereby corrected as shown below:

Column 3 line 38 - change "suitable" to -- slidable --

Column 4 line 30 - change "elongated" to -- elongate --

Column 4 line 67 - before the word "piston" insert -- lower --

Column 6 line 55 - the word "passage" second occurence should be -- passages --

Column 7 line 25 - after the word "again" insert -- , --

Column 7 line 58 - change the word "anvil" to -- drill --

Column 11 line 7 - change "means" first occurence to -- having -

Signed and Sealed this

Twelfth Day of October 1976

[SEAL]

*Attest:*

RUTH C. MASON
*Attesting Officer*

C. MARSHALL DANN
*Commissioner of Patents and Trademarks*